US008603330B1

(12) United States Patent
Jones

(10) Patent No.: US 8,603,330 B1
(45) Date of Patent: Dec. 10, 2013

(54) POOL SKIMMER ENHANCEMENT SYSTEM

(75) Inventor: Ryan C. Jones, Dunedin, FL (US)

(73) Assignee: Crystal Blue Vortek, Belleair Bluffs, FL (US)

( * ) Notice: Subject to any disclaimer, the term of this patent is extended or adjusted under 35 U.S.C. 154(b) by 278 days.

(21) Appl. No.: 13/068,213

(22) Filed: May 5, 2011

Related U.S. Application Data

(63) Continuation-in-part of application No. 12/804,814, filed on Jul. 29, 2010, now Pat. No. 8,382,977, which is a continuation-in-part of application No. 12/586,511, filed on Sep. 23, 2009, now Pat. No. 8,202,416.

(51) Int. Cl.
*E04H 4/12* (2006.01)

(52) U.S. Cl.
USPC ..... 210/167.1; 4/507

(58) Field of Classification Search
USPC ..... 210/167.1, 167.18; 4/507
See application file for complete search history.

(56) References Cited

U.S. PATENT DOCUMENTS

| | | | | |
|---|---|---|---|---|
| 3,668,713 | A * | 6/1972 | Baker | 4/512 |
| 4,649,579 | A * | 3/1987 | Blais | 4/507 |
| 4,818,389 | A * | 4/1989 | Tobias et al. | 210/167.12 |
| 4,904,379 | A * | 2/1990 | Ward | 210/167.18 |
| 5,510,020 | A * | 4/1996 | Gronlund | 210/167.18 |
| 8,202,416 | B1 * | 6/2012 | Jones | 210/167.18 |
| 8,382,977 | B1 * | 2/2013 | Jones | 210/167.18 |
| 2004/0238425 | A1 * | 12/2004 | Hodak | 210/169 |
| 2005/0242014 | A1 * | 11/2005 | Schneider | 210/169 |
| 2009/0120856 | A1 * | 5/2009 | Meagher | 210/167.1 |
| 2010/0310314 | A1 * | 12/2010 | Juel | 405/94 |

* cited by examiner

*Primary Examiner* — Fred Prince

(57) ABSTRACT

A water diverter assembly is positionable in a skimmer chamber between a well and a pool. A bar has opposed ends removably received in and supported by the chamber. First and a second similarly configured plates have interior ends with first radii of curvature adjacent to the well and exterior ends with second radii of curvature greater than the first radii of curvature adjacent to the pool. Regions join the bar and the plates. The plates are closest together at the interface of the interior and exterior ends. The plates increase their separation at the interface during operation and use in response to the flow of water between the plates.

5 Claims, 4 Drawing Sheets

FIG. 3
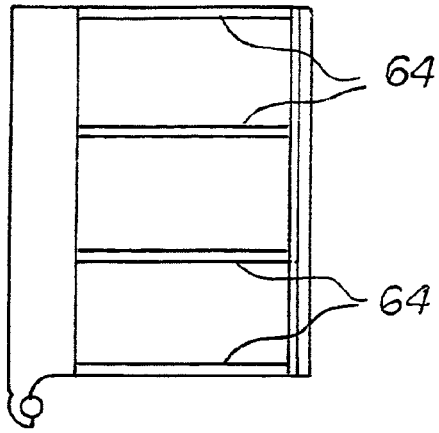
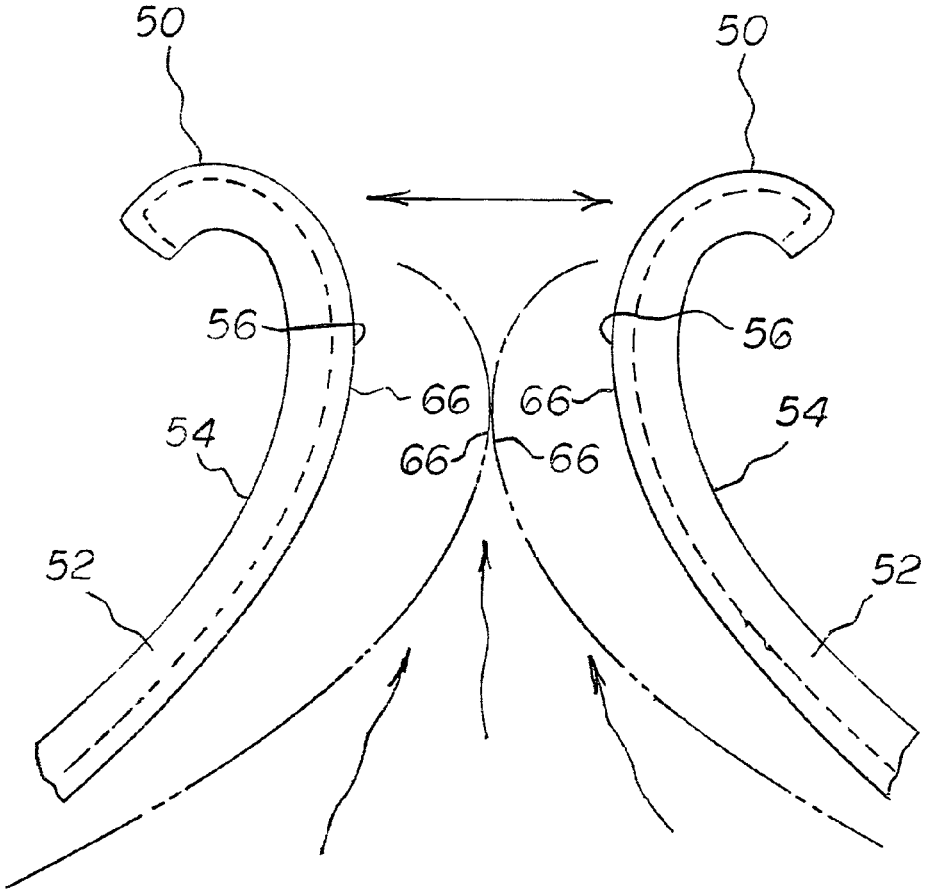
FIG. 4

POOL SKIMMER ENHANCEMENT SYSTEM

RELATED APPLICATION

The present invention is a continuation-in-part of U.S. patent application Ser. No. 12/804,814 filed Jul. 29, 2010, now U.S. Pat. No. 8,382,977, which is a continuation-in-part of U.S. patent application Ser. No. 12/586,511 filed Sep. 23, 2009, now U.S. Pat. No. 8,202,416, the subject matter of which applications is incorporated herein by reference.

BACKGROUND OF THE INVENTION

1. Field of the Invention

The present invention relates to a pool skimmer enhancement system and more particularly pertains to increasing the speed of water flowing through a skimmer thereby maximizing the skimming effectiveness of the system.

2. Description of the Prior Art

The use of pool skimmers of known designs and configurations is known in the prior art. More specifically, pool skimmers of known designs and configurations previously devised and utilized for the purpose of removing debris from swimming pools are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a pool skimmer enhancement system that allows increasing the speed of water flowing through a skimmer thereby maximizing the skimming effectiveness of the system.

In this respect, the pool skimmer enhancement system according to the present invention substantially departs from the conventional concepts and designs of the prior art, and in doing so provides an apparatus primarily developed for the purpose of increasing the speed of water flowing through a skimmer thereby maximizing the skimming effectiveness of the system.

Therefore, it can be appreciated that there exists a continuing need for a new and improved pool skimmer enhancement system which can be used for increasing the speed of water flowing through a skimmer thereby maximizing the skimming effectiveness of the system. In this regard, the present invention substantially fulfills this need.

SUMMARY OF THE INVENTION

In view of the foregoing disadvantages inherent in the known types of pool skimmers of known designs and configurations now present in the prior art, the present invention provides an improved pool skimmer enhancement system. As such, the general purpose of the present invention, which will be described subsequently in greater detail, is to provide a new and improved pool skimmer enhancement system and method which has all the advantages of the prior art and none of the disadvantages.

To attain this, the present invention essentially comprises a pool skimmer enhancement system for increasing the speed of water flowing through a skimmer thereby maximizing the skimming effectiveness of the system. First provided is a swimming pool. The pool has a side wall with a rectangular opening at water level for the passage of water from the pool for the skimming of water and the removal of debris from the skimmed water. The opening has parallel upper and lower horizontal edges and parallel first and second side vertical edges.

A chamber is located interiorly of and at a common elevation with the opening. The chamber has laterally spaced cylindrical recesses adjacent to the lower edge.

A cylindrical well is operatively coupled with the chamber. The cylindrical well has a vertical axis for drawing the water from the pool and chamber into a pump and for filtering out debris.

Next provided is a water diverter assembly. The water diverter assembly is positionable in the chamber between the well and the pool. The diverter assembly has an upper region and a lower region. The lower region is formed as a horizontally extending bar. The bar has opposed ends removably received in the recesses.

The upper region of the diverter assembly has similarly configured first and second plates. Each of the plates is in an arcuate configuration with first and second centers of curvature adjacent to the side edges. The plates have interior ends with first radii of curvature adjacent to the well and exterior ends with second radii of curvature adjacent to the pool. The second radii of curvature is greater than the first radii of curvature. The plates have inner surfaces facing the well and outer surfaces facing the pool.

The diverter assembly has vertical regions adjacent to the side edges joining the bar and the plates. Slots extend upwardly through the bar and into the upper region to separate the vertical regions and the plates. The vertical regions adjacent to the plates are adapted to be bent inwardly to allow insertion of the opposed ends into the recesses and the removal of the opposed ends from the recesses.

Horizontal ribs are provided on the inner surfaces of the plates for strengthening purposes. The ribs are adapted to maintain the shape of the plates during operation and use. The plates are closest together at the interface of the interior and exterior ends. The plates are adapted to increase their separation at the interface during operation and use in response to the flow of water between the plates.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pool skimmer enhancement system which has all of the advantages of the prior art pool skimmers of known designs and configurations and none of the disadvantages.

It is another object of the present invention to provide a new and improved pool skimmer enhancement system which may be easily and efficiently manufactured and marketed.

It is further object of the present invention to provide a new and improved pool skimmer enhancement system which is of durable and reliable constructions.

An even further object of the present invention is to provide a new and improved pool skimmer enhancement system which is susceptible of a low cost of manufacture with regard to both materials and labor, and which accordingly is then susceptible of low prices of sale to the consuming public, thereby making such pool skimmer enhancement system economically available to the buying public.

Even still another object of the present invention is to provide a pool skimmer enhancement system for increasing the speed of water flowing through a skimmer thereby maximizing the skimming effectiveness of the system.

Lastly, it is an object of the present invention to provide a new and improved pool skimmer enhancement system. A water diverter assembly is positionable in a skimmer chamber between a well and a pool. A bar has opposed ends removably received in and supported by the chamber. First and a second similarly configured plates have interior ends with first radii of curvature adjacent to the well and exterior ends with second radii of curvature greater than the first radii of curvature adjacent to the pool. Regions join the bar and the plates. The plates are closest together at the interface of the interior and exterior ends. The plates increase their separation at the interface during operation and use in response to the flow of water between the plates.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the system taken along line 3-3 of FIG. 1.

FIG. 4 is a enlarged showing of water flow taken at Circle 4 of FIG. 2.

The same reference numerals refer to the same parts throughout the various Figures.

DESCRIPTION OF THE PREFERRED EMBODIMENT

Figure 1:
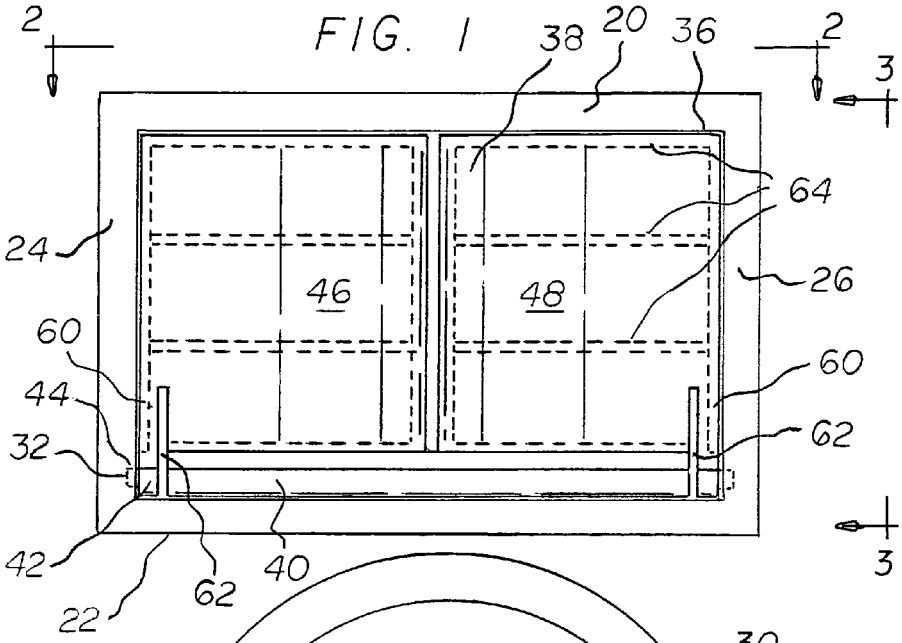
FIG. 1 is a front elevational view of a pool skimmer enhancement system constructed in accordance with the principles of the present invention.
Figure 2:
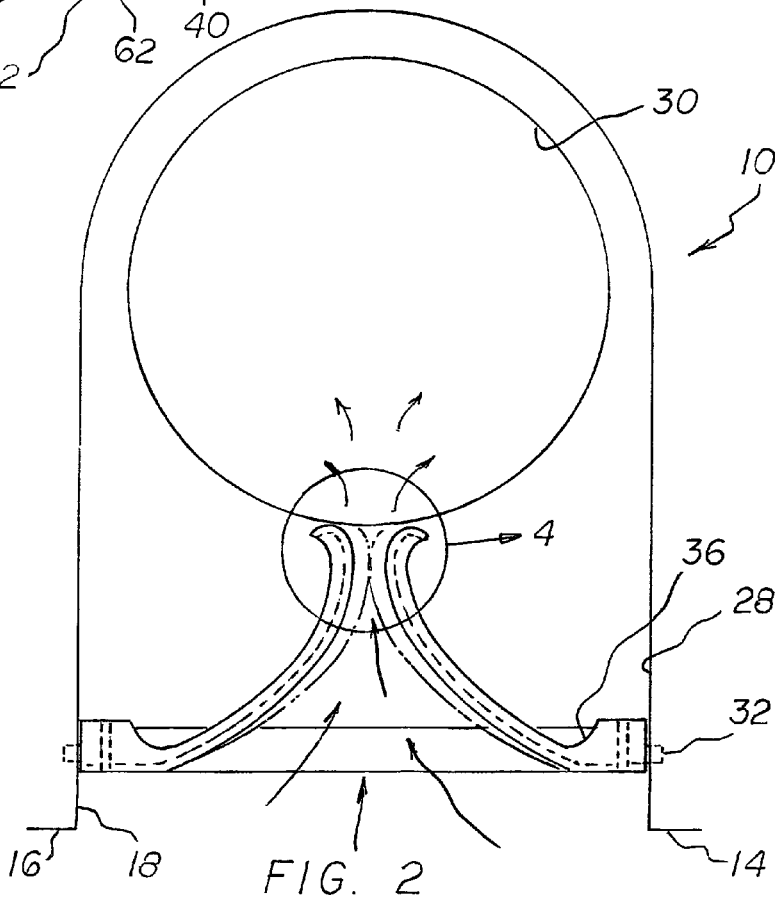
FIG. 2 is a plan view of the system taken along line 2-2 of FIG. 1.

With reference now to the drawings, and in particular to FIG. 1 thereof, the preferred embodiment of the new and improved pool skimmer enhancement system embodying the principles and concepts of the present invention and generally designated by the reference numeral 10 will be described.

The present invention, the pool skimmer enhancement system 10 is comprised of a plurality of components. Such components in their broadest context include a water diverter assembly, a bar, first and a second similarly configured plates, and regions joining the bar and the plates. Such components are individually configured and correlated with respect to each other so as to attain the desired objective.

The pool skimmer enhancement system 10 is for increasing the speed of water flowing through a skimmer thereby maximizing the skimming effectiveness of the system. First provided is a swimming pool 14. The pool has a side wall 16 with a rectangular opening 18 at water level for the passage of water from the pool for the skimming of water and the removal of debris from the skimmed water. The opening has parallel upper and lower horizontal edges 20, 22 and parallel first and second side vertical edges 24, 26.

A chamber (28) is located interiorly of and at a common elevation with the opening. The chamber has laterally spaced cylindrical recesses (32) adjacent to the lower edge.

A cylindrical well (30) is operatively coupled with the chamber. The cylindrical well has a vertical axis for drawing the water from the pool and chamber into a pump and for filtering out debris.

Next provided is a water diverter assembly 36. The water diverter assembly is positionable in the chamber between the well and the pool. The diverter assembly has an upper region 38 and a lower region 40. The lower region is formed as a horizontally extending bar 42. The bar has opposed ends 44 removably received in the recesses.

The upper region of the diverter assembly has similarly configured first and second plates 46, 48. Each of the plates is in an arcuate configuration with first and second centers of curvature adjacent to the side edges. The plates have interior ends 50 with first radii of curvature adjacent to the well and exterior ends 52 with second radii of curvature adjacent to the pool. The second radii of curvature is greater than the first radii of curvature. The plates have inner surfaces 54 facing the well and outer surfaces 56 facing the pool.

The diverter assembly has vertical regions 60 adjacent to the side edges joining the bar and the plates. Slots 62 extend upwardly through the bar and into the upper region to separate the vertical regions and the plates. The vertical regions adjacent to the plates are adapted to be bent inwardly to allow insertion of the opposed ends into the recesses and the removal of the opposed ends from the recesses.

Horizontal ribs 64 are provided on the inner surfaces of the plates for strengthening purposes. The ribs are adapted to maintain the shape of the plates during operation and use. The plates are closest together, preferably touching, at the interface 66 of the interior and exterior ends. The plates are adapted to increase their separation at the interface during operation and use in response to the flow of water between the plates.

Figure 5:
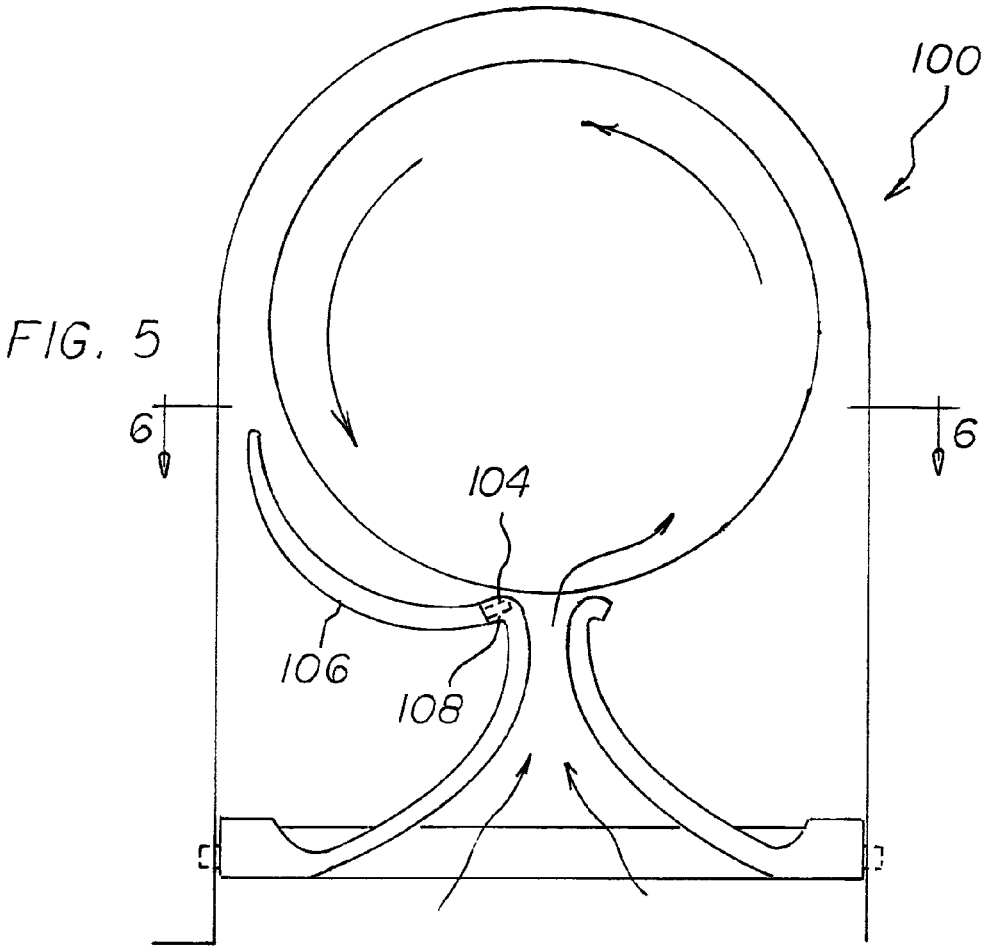
FIG. 5 is a front elevational view similar to FIG. 1 but illustrating an alternate embodiment of the invention.
Figure 6:
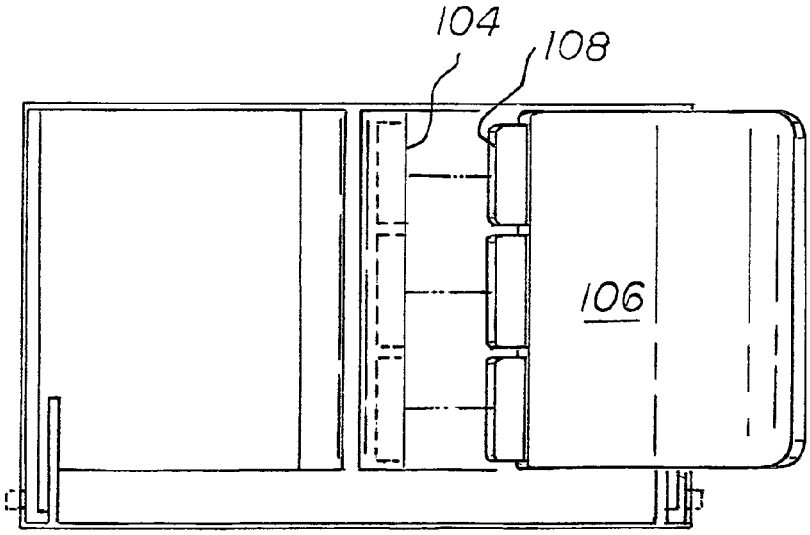
FIG. 6 is a cross sectional view taken along line 6-6 of FIG. 5.

Reference is now made to the alternate embodiment of the invention shown in FIGS. 5 and 6. In this embodiment of the system 100 one of the plates has a free end with recesses 104.

The system of this embodiment further includes an arcuate extension plate 106 with projections 108 removably received in the recesses.

Figure 7:
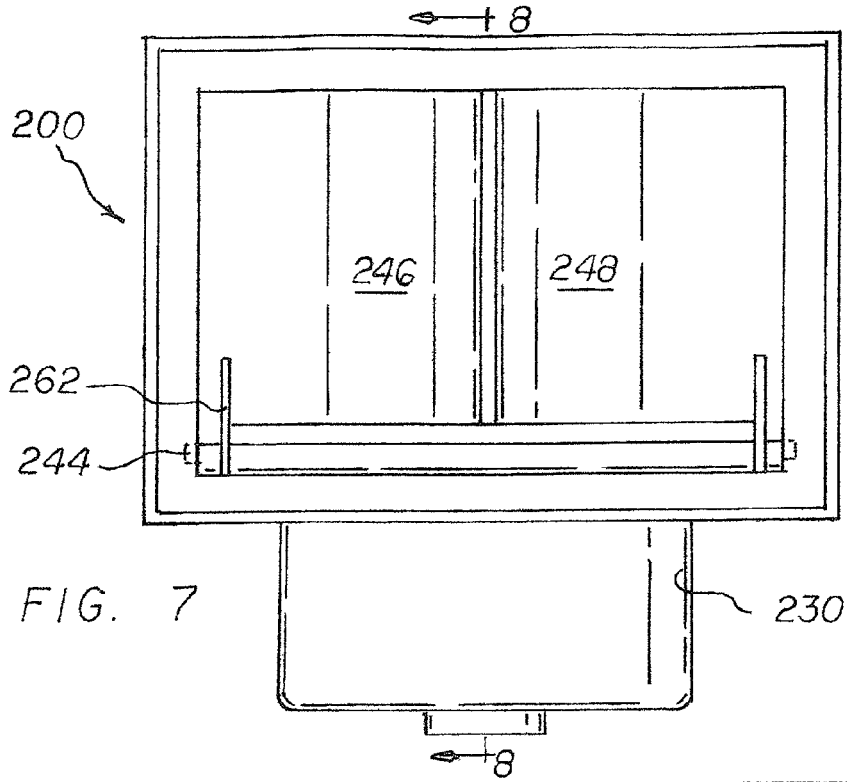
FIG. 7 is a plan view similar to FIGS. 1 and 5 but illustrating another alternate embodiment of the invention.
Figure 8:
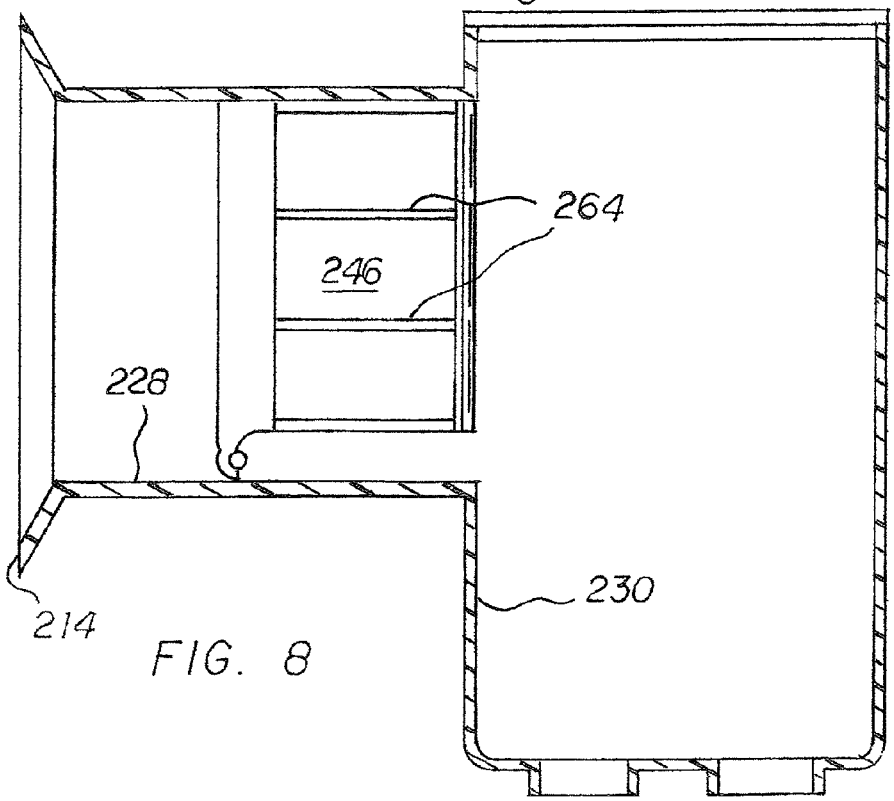
FIG. 8 is a cross sectional view taken along line 8-8 of FIG. 7.

Reference is now made to the alternate embodiment of the invention shown in FIGS. 7 and 8. In this embodiment, the system 200 is fabricated for new installations. The system includes a pool 214 and a chamber 228 and a well 230. Similarly configured plates 246, 248 are in the chamber. The plates have strengthening ribs 264. Projections 244 are coupled to the plates. Vertical regions are adjacent to the plates with vertical slots 262 to facilitate coupling the plates to, and uncoupling the plates from, the chamber.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pool skimmer enhancement system comprising:

a water diverter assembly positionable in a skimmer chamber between a well and a pool;

a bar having opposed ends removably received in and supported by the chamber;

first and a second similarly configured plates, the plates having interior ends with first radii of curvature adjacent to the well and exterior ends with second radii of curvature adjacent to the pool, the second radii of curvature being greater than the first radii of curvature, the plates have free ends facing away from the well; and regions joining the bar and the plates, the plates being closest together at the interface of the interior and exterior ends, the plates adapted to increase their separation at the interface during operation and use in response to the flow of water between the plates.

2. The system (100) as set forth in claim 1 wherein one of the plates has a free end with recesses (104) and further including an arcuate extension plate (106) with projections (108) removably received in the recesses.

3. The system (200) as set forth in claim 1 wherein the system is fabricated for new installations.

4. A pool skimmer enhancement system (10) for increasing the speed of water flowing through a skimmer thereby maximizing the skimming effectiveness of the system, the system comprising, in combination:

a swimming pool (14) having a side wall (16) with a rectangular opening (18) at water level for the passage of water from the pool for the skimming of water and the removal of debris from the skimmed water, the opening having parallel upper and lower horizontal edges (20) (22) and parallel first and second side vertical edges (24) (26);

a chamber (28) located interiorly of and at a common elevation with the opening, the chamber having laterally spaced cylindrical recesses (32) adjacent to the lower edge;

a cylindrical well (30) operatively coupled with the chamber, the cylindrical well having a vertical axis for drawing the water from the pool and chamber into a pump and for filtering out debris;

a water diverter assembly (36) positionable in the chamber between the well and the pool, the diverter assembly having an upper region (38) and lower region (40), the lower region being formed as a horizontally extending bar (42), the bar having opposed ends (44) removably received in the recesses;

the upper region of the diverter assembly having similarly configured first and a second plates (46) (48), each plate being in an arcuate configuration with first and second centers of curvature adjacent to the side edges, the plates having interior ends (50) with first radii of curvature adjacent to the well and exterior ends (52) with second radii of curvature adjacent to the pool, the second radii of curvature being greater than the first radii of curvature, the plates having inner surfaces (54) facing the well and outer surfaces (56) facing the pool, the plates being spaced from each other during operation and use to increase the efficiency of the system through the Bernoulli effect;

the diverter assembly having vertical regions (60) adjacent to the side edges joining the bar and the plates, slots (62) extending upwardly through the bar and into the upper region to separate the vertical regions and the plates, the vertical regions adjacent to the plates adapted to be bent inwardly to allow insertion of the opposed ends into the recesses and the removal of the opposed ends from the recesses; and horizontal ribs (64) on the inner surfaces of the plates for strengthening purposes, the ribs adapted to maintain the shape of the plates during operation and use, the plates being closest together at the interface (66) of the interior and exterior ends, the plates adapted to increase their separation at the interface during operation and use in response to the flow of water between the plates.

5. A pool skimmer enhancement system comprising:

a water diverter assembly positionable in operative proximity to a skimmer chamber between a well and a pool, the water diverter assembly including plates with spaced surfaces adapted to abate the flow of water from the pool to the well, the water diverter assembly including at least one spaced opening adapted to allow the flow of water from the pool to the well, the plates being spaced from each other during operation and use to increase the efficiency of the system through the Bernoulli effect; and securement mechanisms to couple the water diverter assembly to the pool and the well.

* * * * *

UNITED STATES PATENT AND TRADEMARK OFFICE

CERTIFICATE OF CORRECTION

PATENT NO. : 8,603,330 B1
APPLICATION NO. : 13/068213
DATED : December 10, 2013
INVENTOR(S) : Ryan C. Jones It is certified that error appears in the above-identified patent and that said Letters Patent is hereby corrected as shown below:

Title Page, (73) Assignee is corrected to read, Crystal Blue Vortex LLC, Belleair Bluffs, FL (US)

Signed and Sealed this
First Day of April, 2014

Michelle K. Lee

Michelle K. Lee
*Deputy Director of the United States Patent and Trademark Office*